US008528897B2

(12) United States Patent
Takeshita et al.

(10) Patent No.: US 8,528,897 B2
(45) Date of Patent: Sep. 10, 2013

(54) RECORDING APPARATUS

(75) Inventors: Sanshiro Takeshita, Shiojiri (JP); Takehiko Saito, Matsumoto (JP); Hidenao Suzuki, Matsumoto (JP); Hiroyuki Yoda, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/365,694

(22) Filed: Feb. 3, 2012

(65) Prior Publication Data

US 2012/0205858 A1 Aug. 16, 2012

(30) Foreign Application Priority Data

Feb. 10, 2011 (JP) ..... 2011-026867
Feb. 10, 2011 (JP) ..... 2011-026868

(51) Int. Cl.
*B65H 31/00* (2006.01)
*B65H 31/08* (2006.01)
*B65H 31/26* (2006.01)

(52) U.S. Cl.
USPC ..... 271/207; 271/209; 271/212; 271/220

(58) Field of Classification Search
USPC ..... 271/220, 207, 3.14, 209, 212, 31.1, 271/3.12, 129
See application file for complete search history.

(56) References Cited

U.S. PATENT DOCUMENTS

| | | | | |
|---|---|---|---|---|
| 4,300,757 | A * | 11/1981 | Koiso et al. | 271/207 |
| 4,858,909 | A * | 8/1989 | Stemmle | 271/184 |
| 5,211,385 | A * | 5/1993 | Hoorn | 271/3.12 |
| 5,618,038 | A * | 4/1997 | Hutson | 271/297 |
| 6,644,654 | B1 * | 11/2003 | Mao | 271/220 |
| 6,848,850 | B2 * | 2/2005 | Matsuo et al. | 400/693 |
| 7,140,796 | B2 * | 11/2006 | Matsuo et al. | 400/693 |
| 7,671,885 | B2 * | 3/2010 | Sasa | 347/262 |
| 2003/0076399 | A1 | 4/2003 | Matsuo et al. | |
| 2005/0093954 | A1 | 5/2005 | Matsuo et al. | |
| 2005/0099482 | A1 | 5/2005 | Matsuo et al. | |
| 2012/0242035 | A1 * | 9/2012 | Yoshida | 271/220 |

FOREIGN PATENT DOCUMENTS

| | | |
|---|---|---|
| JP | 2003-127484 | 5/2003 |
| JP | 2003-252507 | 9/2003 |

* cited by examiner

*Primary Examiner* — Patrick Cicchino
(74) *Attorney, Agent, or Firm* — Workman Nydegger

(57) ABSTRACT

A recording apparatus includes: a holding unit that holds the recorded recording medium fed out from the medium discharge unit in a standing position; and a medium pressing unit that protrudes to the holding unit with respect to a virtual surface in the feeding-out direction of the recording medium by the nip roller of the medium discharge unit, opposite to the holding unit, and presses the recorded recording medium fed out from the medium discharge unit against the holding unit.

8 Claims, 9 Drawing Sheets

FIG. 8

○: SENDING POSSIBLE
△: SENDING POSSIBLE BY ADDITION DRIVING OF DISCHARGE ROLLER AND ONLY SENDING UNSTABLE
×: DISCHARGE IMPOSSIBLE
⧄: DISPOSE IMPOSSIBLE

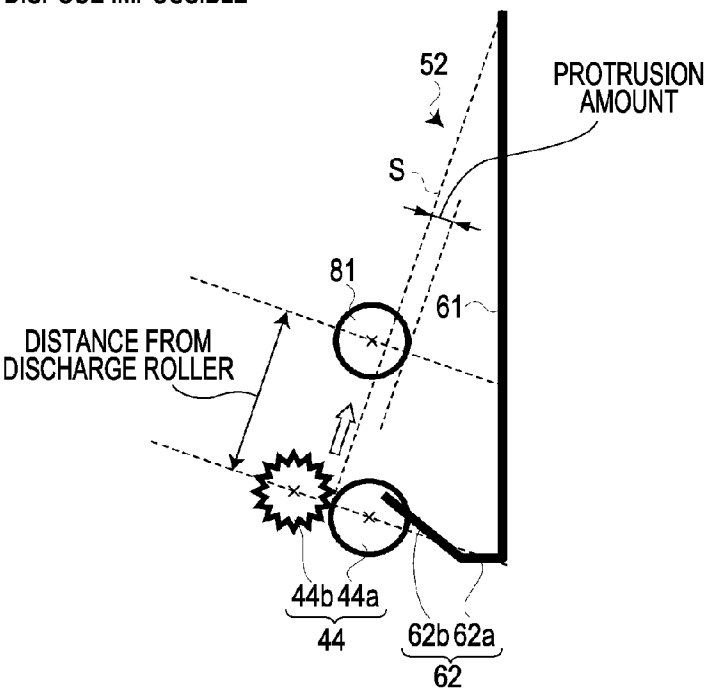

GENERAL COMMON PAPER

| PROTRUSION AMOUNT | DISTANCE FROM DISCHARGE ROLLER 10 | 13 | 16 | 19 | 22 |
|---|---|---|---|---|---|
| 0 | △ | △ | △ | △ | △ |
| 2 | ○ | △ | △ | △ | △ |
| 4 | ○ | ○ | ○ | △ | △ |
| 6 | ○ | ○ | ○ | ○ | △ |
| 8 | ○ | ○ | ○ | ○ | ⧄ |
| 10 | ○ | ○ | ⧄ | ⧄ | ⧄ |

LOW FLEXIBLE COMMON PAPER

| PROTRUSION AMOUNT | DISTANCE FROM DISCHARGE ROLLER 10 | 13 | 16 | 19 | 22 |
|---|---|---|---|---|---|
| 0 | × | × | × | × | × |
| 2 | × | × | × | × | × |
| 4 | ○ | × | × | × | × |
| 6 | ○ | △ | △ | △ | × |
| 8 | ○ | ○ | ○ | △ | ⧄ |
| 10 | ○ | ○ | ⧄ | ⧄ | ⧄ |

PHOTOGRAPH PAPER (= HIGH FLEXIBLE PAPER)

| PROTRUSION AMOUNT | DISTANCE FROM DISCHARGE ROLLER 10 | 13 | 16 | 19 | 22 |
|---|---|---|---|---|---|
| 0 | × | △ | △ | △ | △ |
| 2 | ○ | ○ | ○ | ○ | ○ |
| 4 | ○ | ○ | ○ | ○ | ○ |
| 6 | ○ | ○ | ○ | ○ | ○ |
| 8 | ○ | ○ | ○ | ○ | ⧄ |
| 10 | ○ | ○ | ⧄ | ⧄ | ⧄ |

RECORDING APPARATUS

BACKGROUND

1. Technical Field

The present invention relates to a recording apparatus holding a recorded recording medium in a standing posture.

2. Related Art

A recording apparatus including a recording unit that performs recording on a recording medium, a discharge-side transporting mechanism that transports a recorded recording medium, a discharge-side accommodating unit that receives a recorded recording medium transported by the discharge-side transporting mechanism, and a pushing body that pushes the recording medium transported by the discharge-side transporting mechanism into the discharge-side accommodating unit has been known in the related art (see JP-A-2003-252507).

The discharge-side transporting mechanism has a driving roller and a counter-roller and feeds the recording medium to the discharge-side accommodating unit by using the rollers. Meanwhile, the pushing body is a moving body or a rotary body operating, close to the discharge-side accommodating unit, and pushes the rear end portion (lower end portion) of the recording medium to the right plate (holding surface) of the discharge-side accommodating unit. Accordingly, it is possible to prevent jam due to stopping of the rear end portion of the recording medium close to the driving roller and the counter-roller.

However, according to the configuration, since the pushing body is implemented by a movable moving body or rotary body, a driving source for moving the pushing body is necessary. Accordingly, there is a problem in that the recording apparatus becomes complicated. Further, when the rear end of a recording medium is pushed by a movable moving body or rotary body, it is necessary to move the pushing body after the recording medium comes out from the driving roller and the counter-roller. That is, there is a problem in that complicated control is necessary.

SUMMARY

An advantage of some aspects of the invention is to provide a recording apparatus that can feed out the lower end of a recording medium to a holding surface from the vicinity of a medium discharge unit, with a simple configuration without complicated control.

According to an aspect of the invention, there is provided a recording apparatus including: an image recording unit that records an image on a recording medium; a medium discharge unit that includes a nip roller composed of a driving roller and a driven roller and feeds out a recorded recording medium upward; a holding unit that holds the recorded recording medium fed out from the medium discharge unit; and a medium pressing unit that protrudes to the holding unit with respect to a virtual surface in the feeding-out direction of the recording medium by the nip roller of the medium discharge unit, opposite to the holding unit, and presses the recorded recording medium fed out from the medium discharge unit to the holding unit.

According to this configuration, since the medium pressing unit protrudes to the holding surface from the virtual surface in the feeding-out direction of the recording medium, the recording medium that is being fed out is pressed against the holding surface at all time. Further, when the recording medium is completely fed out from the medium discharge unit, the medium pressing unit presses the lower portion of the recording medium and the lower end of the recording medium is a free state, such that the lower end of the recording medium is moved to the holding surface. As described above, it is possible to feed out the lower end of the recording medium to the holding surface from the vicinity of the medium discharge unit. Meanwhile, since the medium pressing unit has the structure that allows the recording medium to be fed out in a protruding state, it is possible to provide the recording apparatus that holds the paper to overlap each other without making the paper pressing unit a movable type, and that has a simple configuration without complicated control.

Further, as the recording medium is pressed against the driving roller by the medium pressing unit disposed above (downstream of) the medium discharge unit, it is possible to improve transport force of the driving roller by increasing friction force between the recording medium and the driving roller to suppress slip. Since the transport force of the driving roller is not improved directly by the driven roller, it is possible to achieve transport force for stably feeding out recording medium, with the pinching force of the driving roller and the driven roller maintained.

In the apparatus, the driving roller of the nip roller of the medium discharge unit may be disposed at the side of the holding unit.

According to this configuration, the driving roller comes in rotation contact with the lower end portion of the recording medium right after being fed out, from below. As a result, feeding force to the holding unit is applied to the recording medium while the lower end portion of the recording medium is supported on the outer circumference surface of the driving roller.

In the apparatus, the lower end of the recorded recording medium fed out from the medium discharge unit may be moved to the holding unit by the driving roller.

According to this configuration, since the driving roller comes in direct contact with the print surface of the recording medium, the print surface is less contaminated or damaged.

In the apparatus, the holding unit may have an inclined portion that guides the lower end of the recording medium, which is moved to the holding unit by the driving roller, downward at an angle.

According to this configuration, the lower portion of the recording medium can be smoothly guided to a holding position by the inclined portion.

In the apparatus, the holding unit may have a support portion that continues into the inclined surface and supports the recording medium.

According to this configuration, the recording medium can be appropriately held at the holding position by the support portion. Further, it is possible to effectively prevent contact between the held recording medium and the medium discharge unit.

In the apparatus, the medium pressing unit may include a freely rotatable roller that rotates in contact with the recording medium.

According to this configuration, it is possible to reduce frictional resistance against the feeding-out by the medium pressing unit. Therefore, it is possible to stably feed out the recording medium to overlap the previous recording medium.

In the apparatus, a plurality of the medium pressing units may be disposed in the direction perpendicular to the feeding-out direction.

According to this configuration, since the recording medium is pressed at a plurality of positions in the width direction, it is possible to press the recording medium throughout the width region. Therefore, it is possible to reliably feed out the lower end portion of the recording medium to the holding surface.

The recording apparatus may further include a guide roller that is disposed upstream from the medium discharge unit and comes in contact with the surface opposite to the surface of the holding unit of the recording medium, in which the guide roller may protrude to the holding unit with respect to the virtual surface and presses the recording medium against the holding unit.

According to this configuration, since the medium guide unit is disposed at the side of the driven roller, under, that is, upstream from the medium discharge unit, the medium guide unit relatively presses the recording medium against the driving roller. That is, the medium guide unit presses both upper and lower sides (both upstream and downstream sides) in cooperation with the medium pressing unit, thus it is possible to further improve the transport force of the driving roller.

Further, the recording apparatus may include a medium cassette that accommodates a non-recorded recording medium in a standing posture, and is detachable and attachable in which the holding unit may be formed on the outer surface of the medium cassette.

In the recording apparatus holding the recorded recording medium in a standing posture, generally, the recording medium is held with the upper portion exposed outside the apparatus and the recording medium is taken out from the apparatus by the exposed portion. However, when a recording medium with small dimensions, such as a postcard, is held, the upper portion of the recording medium is not exposed outside the apparatus, such that it is difficult to take out the recording medium.

On the other hand, according to the configuration, since the holding unit can be separated as an integral unit with the medium cassette, it is possible to easily take out a holding unit even if the recording medium with small dimensions is held.

The recording apparatus of the invention includes: an image recording unit that records an image on a recording medium; a holding unit that holds the recorded recording medium in a standing posture or on a holding surface to overlap each other; a medium discharge unit that feeds out the recorded recording medium along the holding surface from below; a medium pressing unit that is positioned under the recording medium right after being fed out, protrudes to the holding surface with respect to the virtual surface which becomes the feeding-out direction of the recording medium by the medium discharge unit, and presses the recording medium against the holding surface.

According to this configuration, since the medium pressing unit protrudes to the holding unit from the virtual surface which becomes the feeding-out direction of the recording medium, the recording medium that is being fed out is pressed against the holding surface. Further, when the recording medium is completely fed out from the medium discharge unit, the medium pressing unit presses the lower portion of the recording medium and the lower end of the recording medium is in a free state, such that the lower end of the recording medium is moved to the holding surface. As described above, it is possible to feed out the lower end of the recording medium to the holding unit from the vicinity of the medium discharge unit. Meanwhile, since the medium pressing unit has a structure that allows the recording medium to be fed out in a protruding state, it is possible to provide the recording apparatus that holds the paper to overlap each other without making the paper pressing unit in a movable type, and that has a simple configuration without complicated control.

The recording apparatus of the invention includes: an image recording unit that records an image on a recording medium; a medium discharge unit that includes a nip roller composed of a driving roller and a driven roller and feeds out a recorded recording medium upward; and a medium pressing unit that is disposed above the medium discharge unit, disposed at the driven roller side while protruding to the driving roller with respect to the virtual surface which becomes the feeding-out direction of the recording medium by the medium discharge unit, and presses the recording medium against the driving roller.

According to this configuration, as the recording medium is pressed against the driving roller by the medium pressing unit disposed above (downstream from) the medium discharge unit, it is possible to improve transport force of the driving roller by increasing friction force between the recording medium and the driving roller to suppress slip.

Since the transport force of the driving roller is not increased directly by the driven roller, it is possible to achieve transport force for stably feeding out the recording medium, with the pinching force of the driving roller and the driven roller maintained.

BRIEF DESCRIPTION OF THE DRAWINGS

The invention will be described with reference to the accompanying drawings, wherein like numbers reference like elements.

FIG. 8 is a view showing the relationship of the feeding accuracy of the lower end of the paper, the position of a pressing roller, and the stiffness of paper.

DESCRIPTION OF EXEMPLARY EMBODIMENTS

Hereinafter, a recording apparatus according to an embodiment of the invention is described with reference to the accompanying drawings. The recording apparatus performs desired recording while transporting paper (recording medium) held in a standing posture and holds (stocks or accumulates) the discharged printed paper to overlap each other in a standing state. Further, the X-axial (left-right) direction, the Y-axial (front-rear) direction, and the Z-axial (up-down) direction are defined, as shown in the figures, which are described below. Further, although the recording apparatus 1 is implemented to able to perform longitudinal disposition and lateral disposition (disposition for performing printing on paper and discharging the paper in a horizontal position), the longitudinal disposition is described below. Further, a recording apparatus implemented only for longitudinal disposition may be used.

Figure 1:
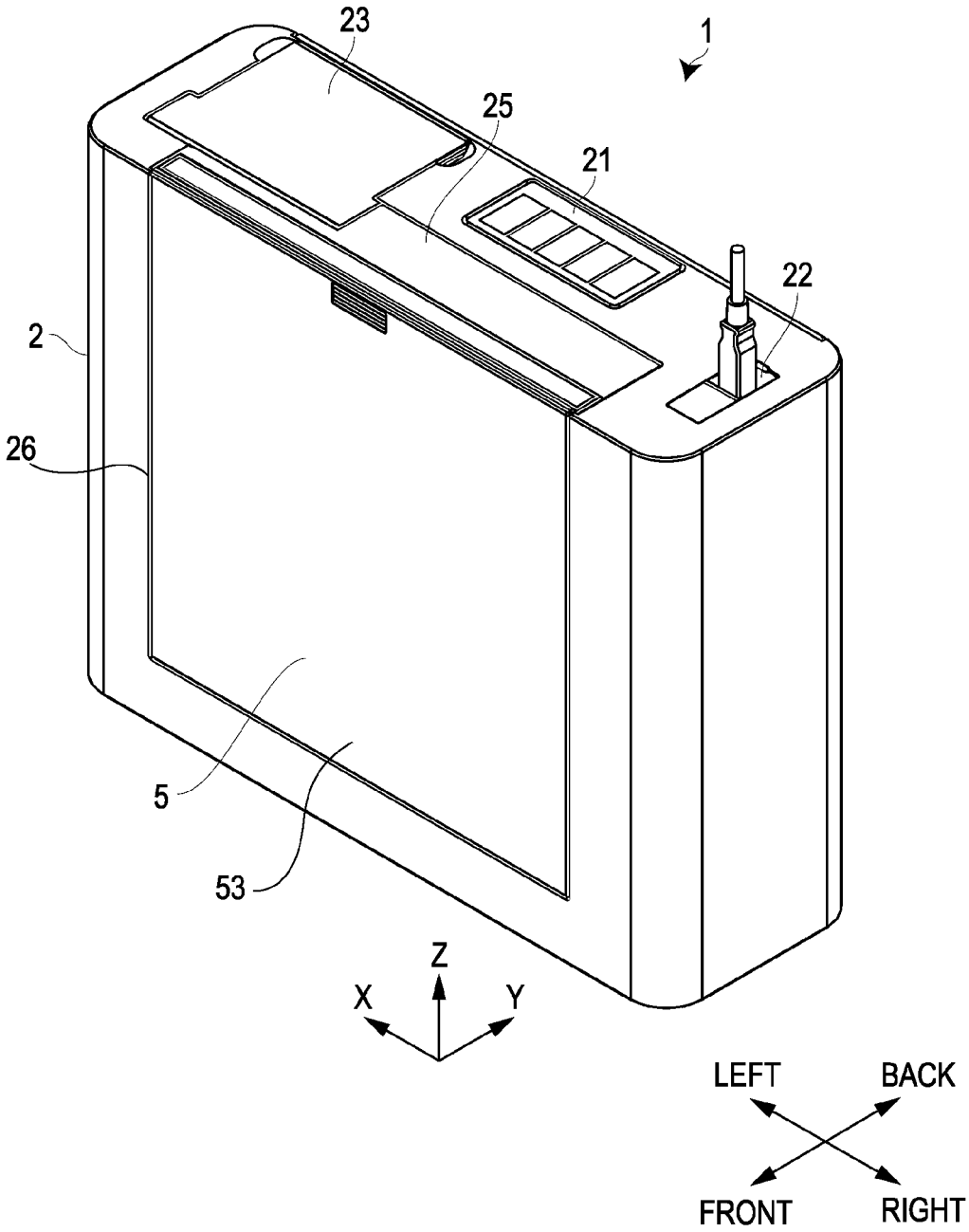
FIG. 1 is a perspective view showing the external appearance of a recording apparatus according to an embodiment.

FIG. 1 is a perspective view showing the external appearance of the recording apparatus 1. As shown in FIG. 1, the recording apparatus 1 has the external appearance formed by a case 2 having a thin box shape with the Z-axial dimension larger than the X-axial and Y-axial dimensions. An operation panel 21 with operation buttons, a cable terminal 22 where a cable for connecting a PC or the like is connected, and a cartridge cover 23 opening/closing a cartridge mount (not shown) for separably mounting a plurality of ink cartridges (not shown) are disposed on the top of the case 2. Further, a paper outlet cover 25 opening/closing a paper outlet 24 (see FIG. 2) for discharging recorded paper P is disposed on the top of the case 2. Further, the paper outlet cover 25 is opened/closed by a user, but is automatically opened by an opening/closing mechanism (not shown) even if recording is performed with the cover closed. Further, a cassette mount 26 for separably mounting a paper cassette 5, which is described below, is widely disposed on the front of the case 2.

Figure 2:
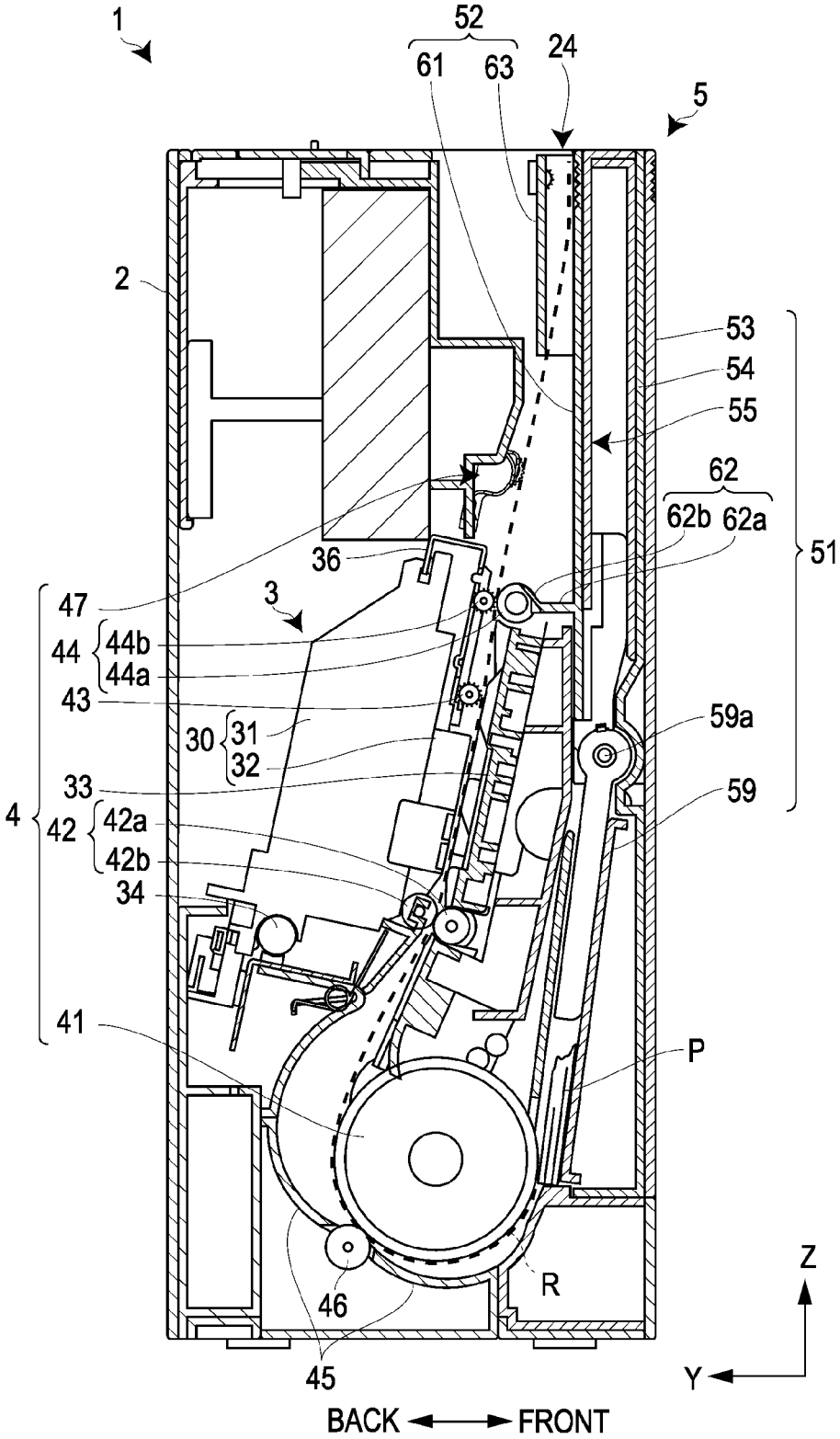
FIG. 2 is a lateral cross-sectional view showing the internal structure of the recording apparatus.

The internal structure of the recording apparatus 1 is described in detail with reference to FIG. 2. FIG. 2 is a lateral cross-sectional view showing the internal structure of the recording apparatus 1. As shown in FIG. 2, the recording apparatus 1 includes; a paper cassette 5 separably mounted on the cassette mount 26 and accommodating sheets of paper P in a standing state; a transporting unit 4 feeding the accommodated paper P along a transport path R for turning over and feeding the paper P upward, at the lower portion of the recording apparatus 1; a printing unit (image recording unit) 3 disposed in contact with the transport path R or at the vertical middle position of the recording apparatus 1 and performing ink jet type printing on the paper P; and an apparatus frame (not shown) supporting the transporting unit 4 and the printing unit 3. Further, the printing unit 3 that has performed printing on the paper P is an example of an image recording unit recording an image on a recording medium and recording the image on the recording medium is not limited to the ink jet type and may be implemented by other types.

The printing unit 3 is supported by the apparatus frame and includes a carriage guide shaft 34 and a carriage guide plate 36 which X-axially extend the full width, a carriage unit 30 supported by the carriage guide shaft 34 and the carriage guide plate 36 to be able to reciprocate, and a carriage moving mechanism 37 (see FIG. 3) reciprocating the carriage unit 30 along the carriage guide shaft 34 and the carriage guide plate 36. The carriage guide shaft 34 supports the lower end of the carriage unit 30 and the carriage guide plate 36 supports the upper end of the carriage unit 30 against the force causing a rotation about the carriage guide shaft 34. That is, the carriage unit 30 is held at an angle by the carriage guide shaft 34 and the carriage guide plate 36.

Figure 3:
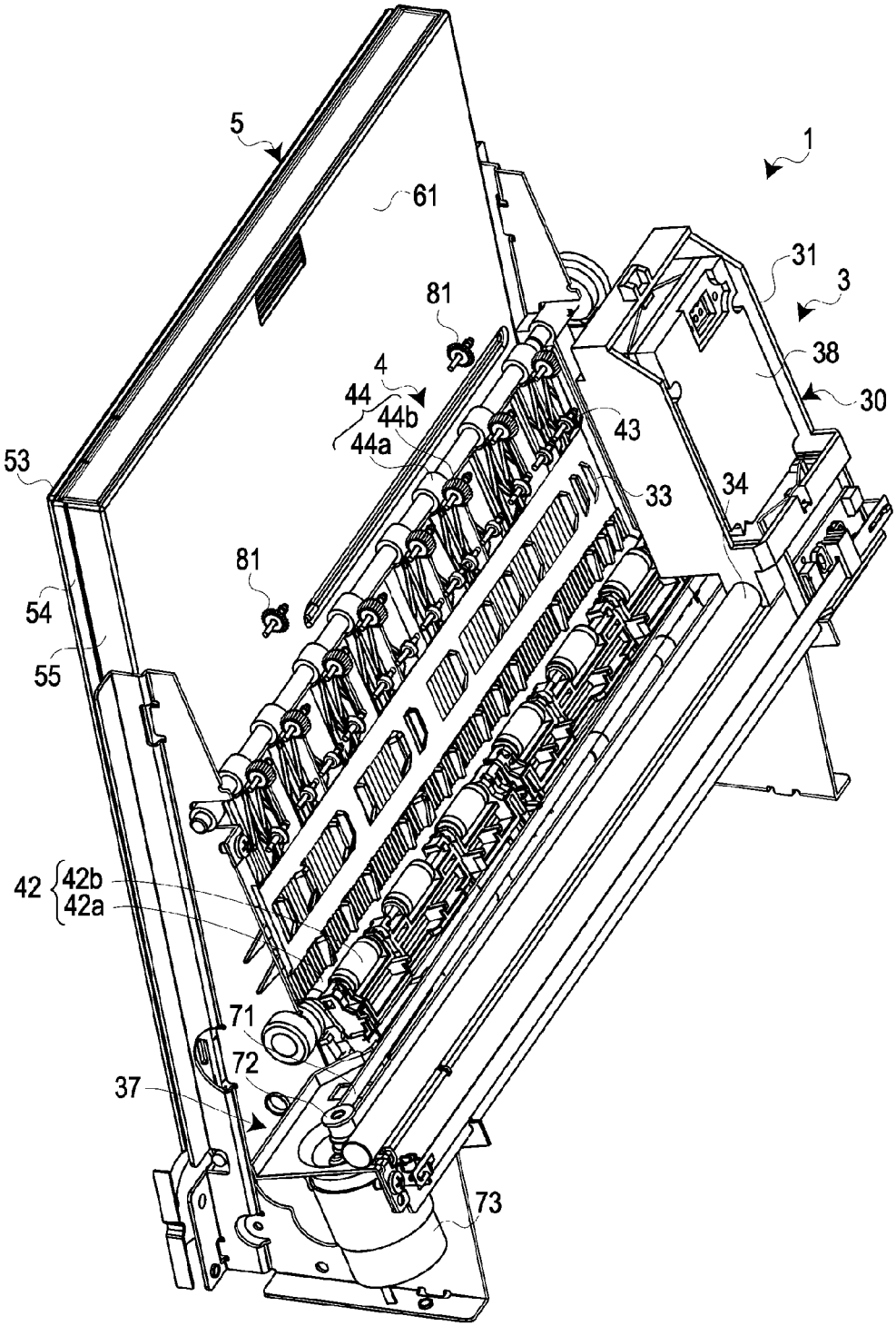
FIG. 3 is a rear perspective view showing the internal structure of the recording apparatus.

FIG. 3 is a rear perspective view showing the internal structure of the recording apparatus 1. FIG. 3 shows that some of the members are omitted. As shown in FIG. 3, the carriage unit 30 includes a carriage 31 having a box shape supported by the carriage guide shaft 34 and the carriage guide plate 36 to be able to reciprocate, an ink jet head 32 (see FIG. 2) mounted on the carriage 31, and a connection adapter 38 connected to the ink jet head 32 from above and connected to the ink cartridge through an ink tube (not shown). The ink jet head 32 has a plurality of nozzle lines (not shown) discharging ink droplets of a plurality of colors, opposite the paper P with a predetermined gap therebetween.

The carriage moving mechanism 37 includes a timing belt 71 extending along the carriage guide shaft 34, driving pulley 72 and a driven pulley (not shown) which hold the timing belt 71, a connecting-fixing portion (not shown) connecting the timing belt 71 with the carriage unit 30 (carriage 31), and a carriage motor 73 driving the driving pulley 72. As the carriage motor 73 rotates forward and backward, the carriage unit 30 is X-axially reciprocated (in left-right direction) through the timing belt 71. With the reciprocation, the ink jet head 32 of the carriage unit 30 performs discharging and driving, thereby performing so-called main scanning.

Further, although the ink cartridge independently is disposed from the carriage 31 which is a so-called off-typed cartridge in the embodiment, a so-called on-typed cartridge where the ink cartridge is mounted on the carriage 31 may be used. Further, although a so-called serial printer in which the carriage 31 performs recording while X-axially moving is exemplified in the embodiment, a fixing-typed ink jet head 32 covering the width of paper P may be used. Further, the invention is not limited to the ink jet type and may be applied to other recording types.

Figure 4:
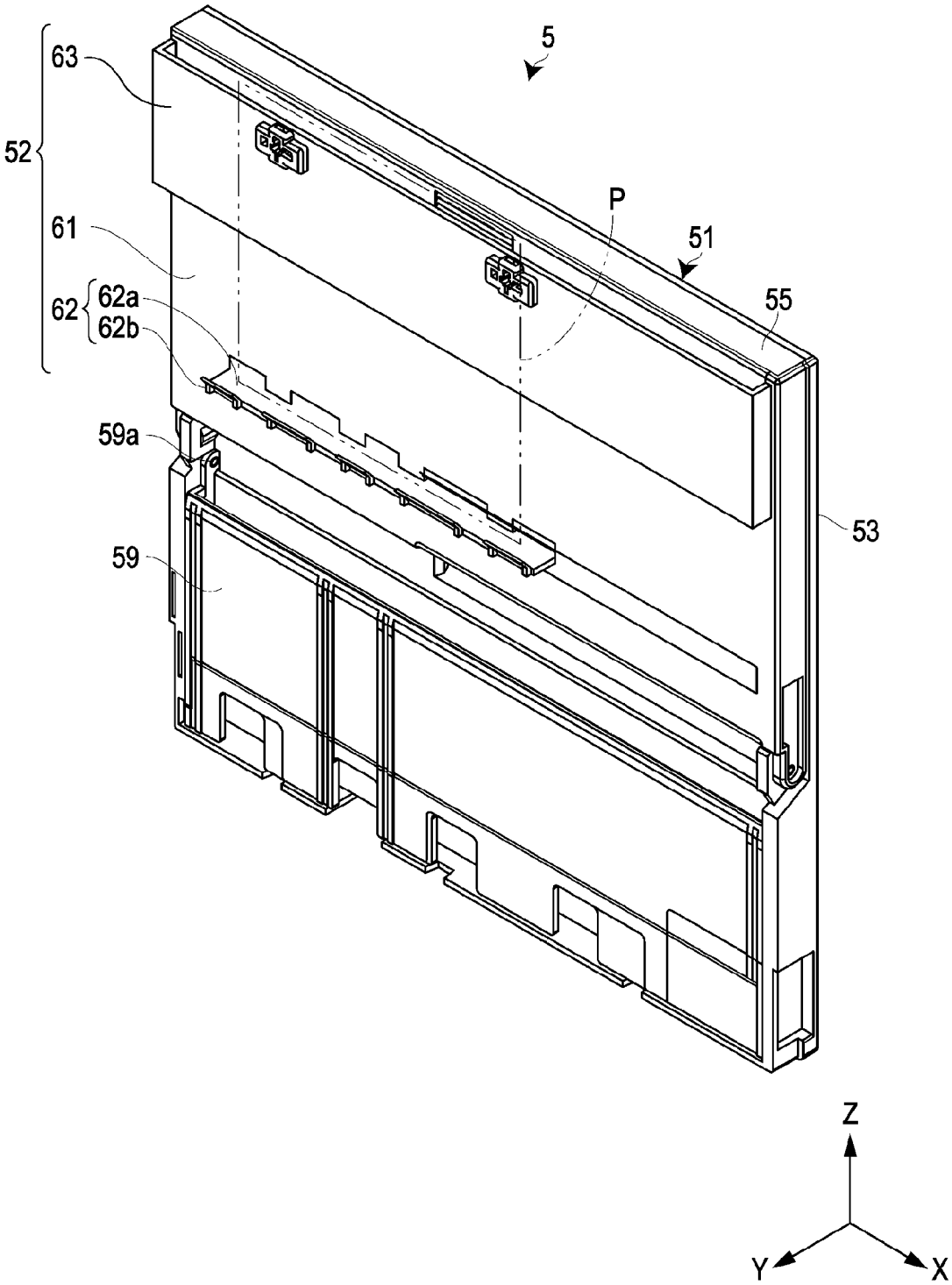
FIG. 4 is a rear perspective view showing a paper cassette.

FIG. 4 is a rear perspective view showing the paper cassette 5. As shown in FIGS. 2 and 4, the paper cassette 5 includes a cassette body (medium cassette) 51 accommodating un-printed (un-recorded) paper P in a standing posture and a discharged-paper holding unit (holding unit) 52 disposed on the outer surface (inside the apparatus) of the cassette body 51 and holding the printed (recorded) paper P in a standing posture or to overlap each other on a holding surface 61. That is, un-printed paper P is supplied from the cassette body 51 and printed paper P is discharged to the discharged-paper holding unit 52. Further, it is possible to take out the held printed paper P with the cassette body 51 by separating the paper cassette 5 from the apparatus body. Further, the inside of the recording apparatus 1 can be exposed by separating the paper cassette 5, such that it is possible to easily alleviate a problem, such as that the paper P is stuck on the transport path R. Further, though not shown, the paper cassette 5 can Z-axially freely slide with respect to the case 2 and the attaching/detaching operation is performed by sliding the paper cassette 5.

The cassette body 51 includes a cassette case part 53 that is mounted to be aligned with the front surface of the case 2 (see FIG. 1) and forms the entire appearance of the recording apparatus 1, a body tray 54 formed entirely in a tray shape with the side of the cassette case part 53 as a accommodating surface, an upper cover 55 opening/closing a paper accommodating space for accommodating the paper P, opposite to the upper portion of the body tray 54, and a movable tray 59 positioned under the body tray 54 and fluctuating the front end of the paper P accommodated in the paper accommodating space.

Further, the outer surface of the upper cover 55, that is, the surface facing the inside of the apparatus when being mounted on the case 2 functions as a holding surface 61 for holding (accumulating) the printed paper P (the detail is provided below).

The movable tray 59 is disposed under the body tray 54, which becomes downstream in the paper-feeding direction, in a state where the paper cassette 5 is mounted, and functions as a hopper. The movable tray 59 can revolve about or around a pair of left and right fluctuation points **59*a* disposed substantially at the center portion in the up-down direction of the body tray 54, and is fluctuated by a driving mechanism (not shown). Accordingly, it is possible to make the front end of the accommodated paper P to the state where the front end comes in press contact with a feeding roller 41, which is described below, (see FIG. 2**), and to the state where the front end is separated (not shown).

As shown in FIG. 2, the transporting unit 4 includes a large-sized feeding roller 41 that comes in rotation contact with the accommodated paper P to take out the paper P and curved-turns over and feeds out the paper P upward, opposite to the front end of the movable tray 59, a guide member 45 and a sub-driven roller 46 that guide the turning-over and feeding, opposite to the feeding roller 41, a transporting roller 42 that feeds the paper P from the feeding roller 41 to the printing unit 3, a guide member 33 facing the printing unit 3, a spur-shaped guide roller 43 that is disposed at a downstream from the guide member 33 and flattens warping paper P, a discharge roller (medium discharge unit) 44 that is disposed at a downstream from the guide roller 43 and discharges the paper P to the discharged-paper holding unit 52, and a paper pressing mechanism 47 that is disposed at a downstream from the discharging roller 44 and presses the paper P against the discharged-paper holding unit 52. Further, the paper pressing mechanism 47 has a function of feeding the lower end of the paper P right after being taken out to the holding surface 61 of the discharged-paper holding unit 52 from the vicinity of the discharge roller 44.

The feeding roller 41 is implemented by a driving roller and transports the paper P taken out from the cassette body 51 in an arc shape along the outer circumference surface. The guide member 45 is formed in the curved shape opposite to the outer circumference surface of the feeding roller 41 and guides the paper P from the outside. The sub-driven roller 46 is implemented by a freely rotating roller and assists the turning over and feeding by coming in rotation contact with the feeding roller 41 pinched with the paper P therebetween. The transporting roller 42 is implemented by a nip roller including a front transport-driving roller 42*a* and a rear transport-driven roller 42*b* and has a function as a main roller that controls feeding (sub-scanning) the paper P. Further, the feeding roller 41 and the transporting roller 42 are implemented by a plurality of separate rollers disposed at appropriate intervals in the width direction of the paper P (X-axial direction), respectively.

The guide member 33 constitutes a portion of the transport path R and defines the gap (working gap) between the recording surface of the paper P and the ink jet head 32 (functions as a so-called platen). Further, a recession accommodating the ink discharged to a region offset from the end of the paper P during borderless printing at a position opposite to the ink jet head 32 is formed at the guide member 33.

An ink absorbing material (not shown) that absorbs ink is disposed in the recession. Further, a waste fluid tank (not shown) storing the waste ink is disposed under the guide member 33.

The discharge roller 44 is implemented by a nip roller including a front discharge-driving roller (driving roller) 44*a* (at the side of the holding surface 61) and a rear discharge-driven roller 44*b* and functions as a tension roller applying tension to the paper P disposed above the guide member 33. Further, the discharge roller 44 is disposed around the lower portion of the discharged-paper holding unit 52 and feeds out the paper P along the holding surface 61 of the discharged-paper holding unit 52. In detail, the feeding-out direction of the paper P by the discharge roller 44 is set to the up-direction inclined toward the paper cassette 5 (see FIG. 5). Accordingly, the discharged paper P is moved upward while sliding on the holding surface 61 (described below) of the discharged-paper holding unit 52 and held on the holding surface 61 of the discharged-paper holding unit 52.

The discharge-driving roller 44*a* is implemented by a rubber roller and the discharge-driven roller 44*b* is implemented by a star wheel (spur-shaped roller). Further, the discharge-driving roller 44*a* and the discharge-driven roller 44*b* are each composed of a plurality of separate rollers disposed at appropriate intervals in the width direction of the paper P (in the X-axial direction) (see FIG. 3). Further, though the detail is described below, the discharge-driving roller 44*a* comes in rotation contact with the lower end of the paper P right after being fed out, from below. As a result, a feeding force to the holding surface 61 is applied to the paper P in the state where the lower end is supported by the outer circumference surface of the discharge-driving roller 44*a*. Accordingly, the feeding out is assisted by the paper pressing mechanism 47. Further, according to this configuration, since the discharge-driving roller 44*a* does not come in direct contact with the print surface of the paper P, it is possible to prevent the print surface from being contaminated or damaged.

The paper P taken out downward by the feeding roller 41 is turned over upward by the feeding roller 41, the guide member 45 and the sub-driven roller 46 and transported to the transporting roller 42. Further, the paper P is pinched between the transporting rollers 42 and the paper P and fed to the printing unit 3. The paper P that has undergone recording in the printing unit 3 is discharged to the discharged-paper holding unit 52 of the paper cassette 5 through the guide roller 43 and the discharge roller 44.

In printing, the paper P is intermittently fed (sub-scanning) substantially in the Z-axial direction by the transporting unit 4 and the carriage unit 30 is X-axially reciprocated (main scanning) by the carriage moving mechanism 37 while the ink jet head 32 is driven, such that image data is printed on the paper P.

Figure 5:
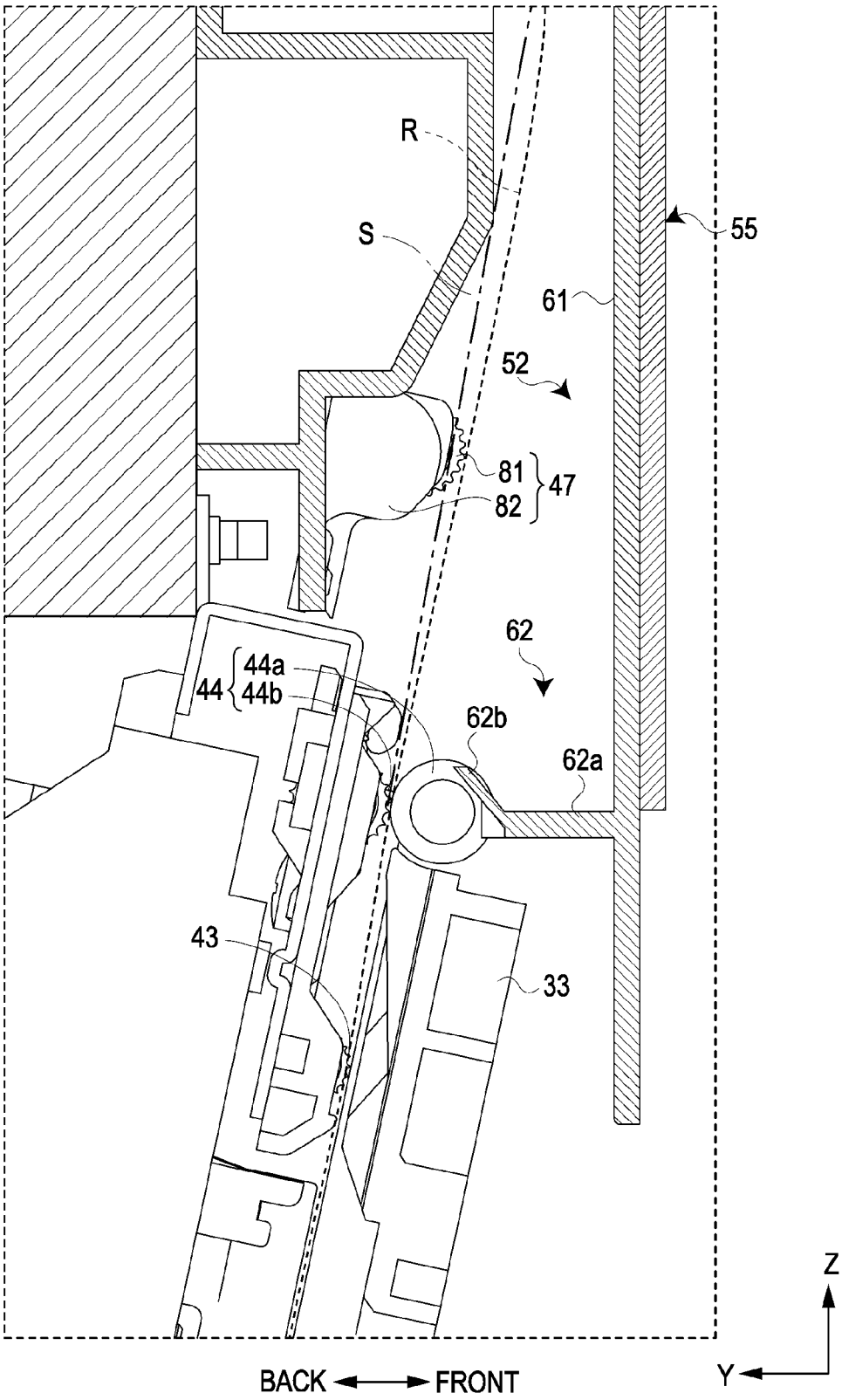
FIG. 5 is a main part cross-sectional view showing a portion including a discharged-paper holding unit and a paper pressing mechanism.

Next, the discharged-paper holding unit 52 and the paper pressing mechanism 47 are described in detail with reference to FIGS. 4, 5, and 6. FIG. 5 is a cross-sectional view showing a portion including the discharged-paper holding unit 52. As shown in FIGS. 4 and 5, the discharged-paper holding unit 52 has the holding surface 61 implemented by the outer surface (inside the apparatus) of the upper cover 55, a accommodating portion 62 accommodating the lower end of the discharged paper P, and a holder 63 disposed on the holding surface 61 and holding the paper P in a standing posture.

The holding surface 61 is a substantially flat surface positioned between the vicinity of the pair of discharge rollers 44 and the paper outlet 24 and a surface vertically extending, when the paper cassette 5 is mounted in the case 2. The paper P discharged by the discharge roller 44 is moved toward the paper outlet 24 while sliding along the holding surface 61. Further, the sheets of paper are held to overlap each other on the holding surface 61. Further, the paper P is made to protrude and discharged upward from the paper outlet 24, depending on the size of the paper P. Therefore, it is preferable for the upper cover 55 to be able to vertically extend/contract.

The accommodating portion 62 has a support portion 62*a* protruding from the holding surface 61 to the discharge roller 44 and supporting the lower end of the paper P and a plurality of paper inlets (inclining portion) 62*b* continued into the tip of the support 62*a* and inclining upward to the discharge-driving roller 44*a*. The paper inlets 62*b* are disposed at appropriate intervals in the X-axial direction in the spaces between the discharge-driving rollers 44*a*, which are the separate rollers. That is, the accommodating portion 62 entirely forms a substantially comb shape. Further, the paper inlets 62*b* appropriately and smoothly guide the lower end of the paper P fed out to the holding surface 61 passing the top of the discharge-driving roller 44*a* by the paper pressing mechanism 47, further, to the holding position. Meanwhile, the support 62*a* supports the paper P moved to the holding position. Therefore, all the paper P fed from the pair of discharge rollers 44 are accommodated (held) to overlap each other by the holding surface 61 and the accommodating portion 62 in the standing posture.

Figure 6:
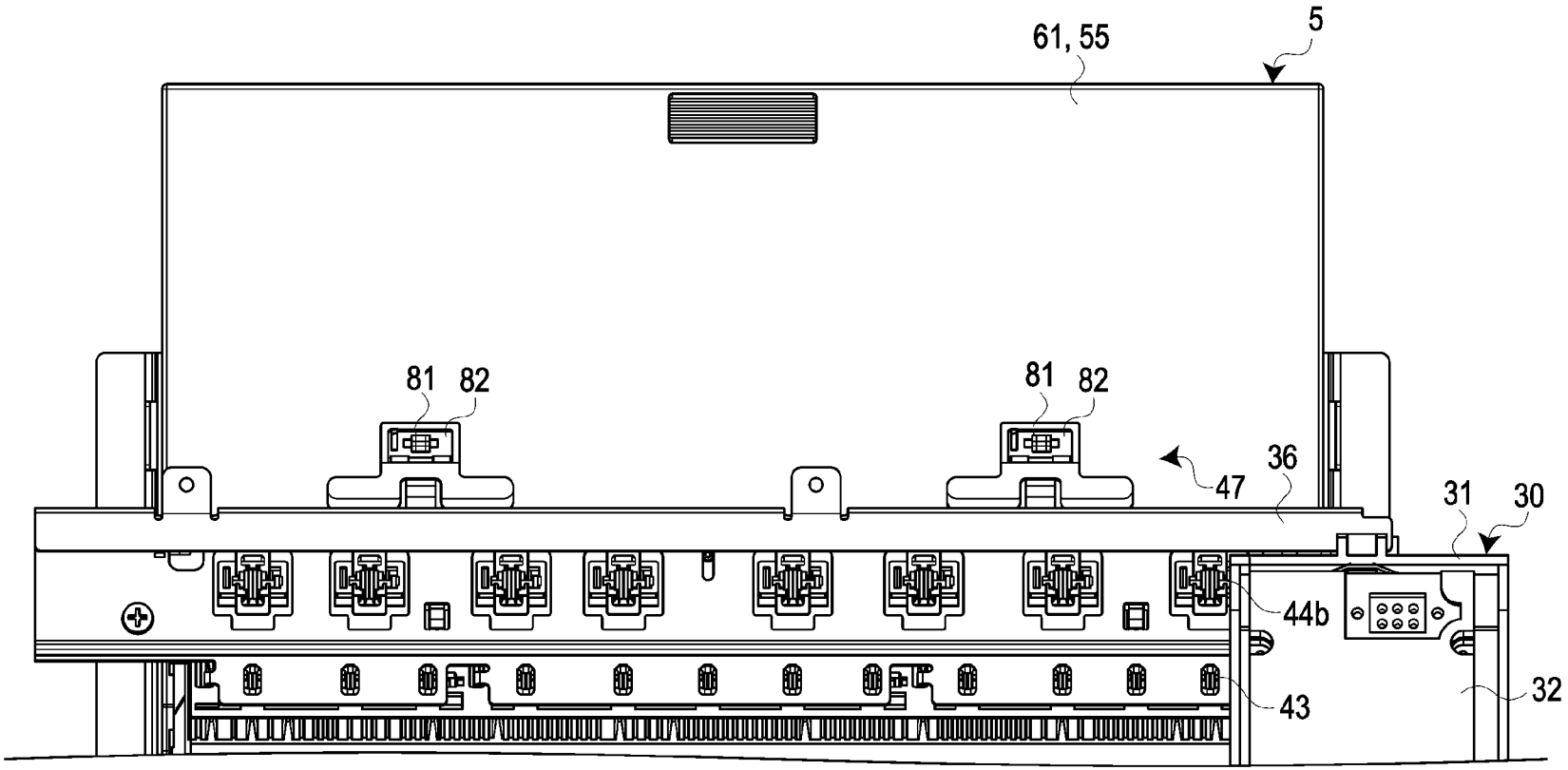
FIG. 6 is a rear view showing a portion including the paper pressing mechanism.

FIG. 6 is a rear view showing a portion including the paper pressing mechanism 47. As shown in FIGS. 5 and 6, the paper pressing mechanism 47 includes a pair of left and right pressing rollers (medium pressing units) 81 pressing the fed paper P against the holding surface 61 by the discharge rollers 44 and a pair of roller frames 82 supported by the apparatus frame and rotatably supporting the pair of pressing rollers 81. Further, in the pair of pressing rollers 81, one pressing roller 81 is positioned to press the paper P with the predetermined minimum width at the center and the other pressing roller 81 is positioned to press the paper P with the predetermined maximum width, good balance between left and right.

Each of the pressing rollers 81 is a freely rotating roller that rotates in contact with the paper P and implemented by a star wheel (spur-shaped roller). Further, the pressing roller 81 is positioned opposite to the lower portion of the paper P right after being fed out and protrudes from the discharge-driven roller 44*b* to the discharge-driving roller 44*a* with respect to a virtual surface S in the feeding-out direction of the discharge roller 44. That is, the pressing roller 81 allows the paper P to be fed out and presses the lower portion of the paper P right after being fed out against the holding surface 61. The paper P is curved by the pressing force and a reaction force for flattening the curve is generated. The reaction force is a feeding force for feeding the lower end of the paper P to the holding surface 61.

Further, the virtual surface S is perpendicular to the surface connecting the axial center of the discharge-driving roller 44*a* and the axial center of the discharge-driven center 44*b* and passing through the nip point between the discharge-driving roller 44*a* and the discharge-driven roller 44*b*.

Figure 7A:
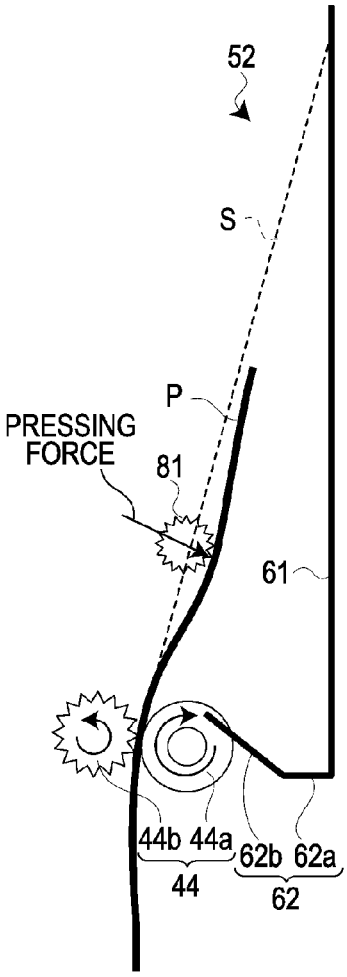
FIGS. 7A to 7C are transition diagrams showing a feeding operation of the paper pressing mechanism.
Figure 7B:
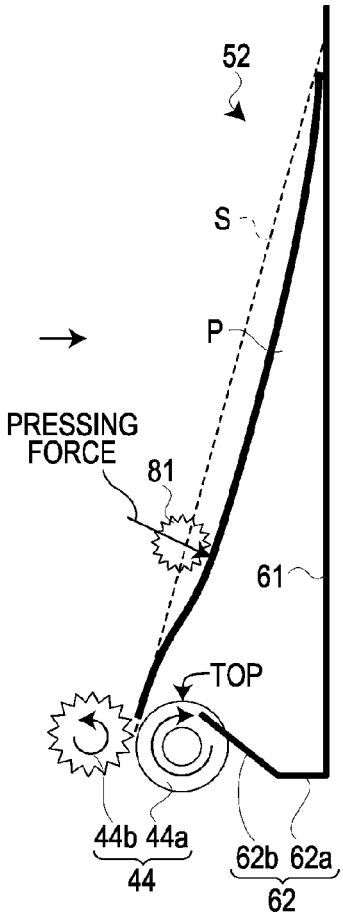
Figure 7C:
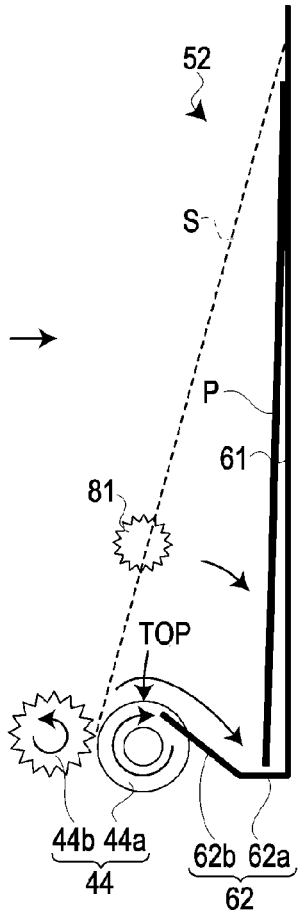

FIGS. 7A to 7C are transition diagrams showing the operation of the paper pressing mechanism 47 feeding the lower portion of the paper P.

As shown in FIGS. 7A to 7C, in the middle of feeding out the paper P, the paper P is fed out by the discharge roller 44 in rotation contact with the surface (print surface) of the pressing rollers 81 and pressed against the holding surface (see FIG. 7A). The pressing rollers 81 come in contact with the lower portion of the paper P and press the paper against the holding surface 61, right after the paper P is fed out. Further, the discharge-driving roller 44*a* comes in rotation contact to the lower end of the paper P from below while remaining driven (see FIG. 7B). The feeding force is applied to the lower end of the paper P by the pressing force of the pressing rollers 81, while the discharge-driving roller 44*a* rotates while supporting the lower end of the paper P in the outer circumference, thereby applying the feeding force to the lower end of the paper P. The lower end of the paper P is fed to the holding surface 61 from the vicinity of the discharge roller 44 by the cooperation of the pressing rollers 81 and the discharge-driving roller 44*a*. The lower end of the paper P passing the top of the discharge-driving roller 44*a* is guided to the paper inlets 62*b* and reaches the support portion 62*a*, and then the paper P is held along the holding surface 61 (see FIG. 7C). A plurality of sheets of paper P is held to appropriately overlap each other by the feeding operation.

FIG. 8 is a view showing the relationship of the feeding accuracy, the position of the pressing rollers 81 and the stiffness of the paper P. As shown in FIG. 8, the accuracy of feeding the paper P is considerably associated with the protrusion amount of the pressing roller 81 with respect to the virtual surface S, the distance from the discharge roller 44 (strictly, the nip point) of the pressing rollers 81 in the feeding-out direction, and the stiffness (stiffness) of the paper P. In detail, basically, as the protrusion amount is large, the distance from the discharge roller 44 is short, and the stiffness of the paper P is large, and the feeding accuracy is high, while the feeding accuracy decreases when they increase exceeded the elastic yield point according to the stiffness of the paper P. Accordingly, considering this feature, it is preferable to set the protrusion amount and the distance from the discharge roller 44 in accordance with predetermined stiffness of the paper P, and dispose the pressing rollers 81. Further, it is necessary to set the protrusion amount of the pressing rollers 81 such that the axial center of the pressing rollers 81 does not cross the virtual surface S such that the upper end portion of the paper is not put into the rears side of the pressing rollers 81.

The guide roller 43 of FIG. 5 is a freely rotating roller that rotates in contact with the paper P and is implemented by a star wheel (spur-shaped roller). Further, the guide roller 43 is implemented by a plurality of separate rollers disposed at appropriate intervals in the width direction of the paper P (X-axial direction). Further, the guide roller 43 is disposed at the upstream of (under) the discharge roller 44, opposite to the transport path R from the side of the discharge-driven roller 44*b*, and protrudes with respect to the virtual surface S. Further, the guide roller 43 flattens warping paper P fed from the guide member 33 and guides the paper P to the discharge roller 44. Further, the guide roller 43 assists pressing against the discharge roller 44*a* of the paper P by the pressing roller 81.

Figure 9:
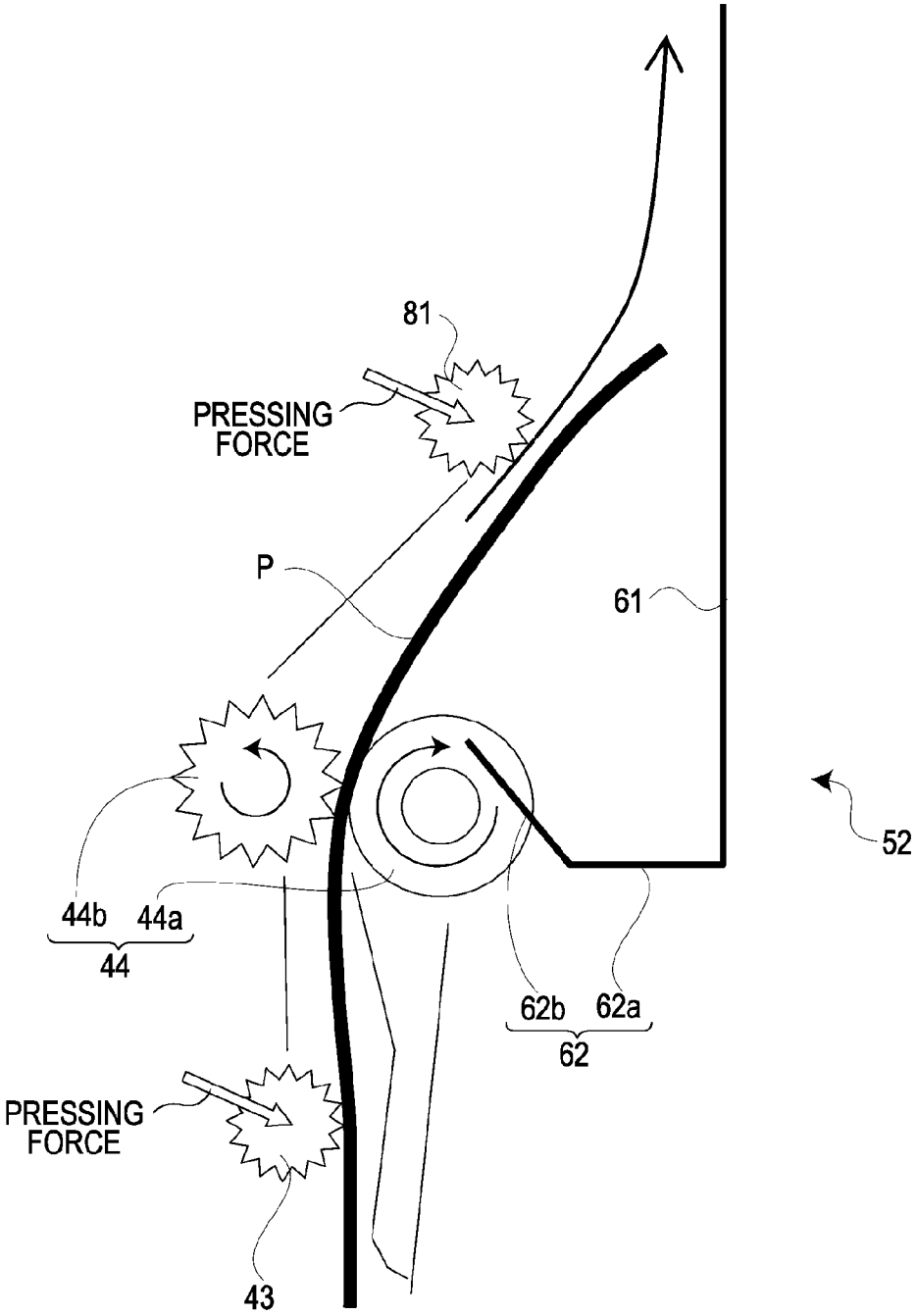
FIG. 9 is a structural view showing the structure of pressing paper against a driving-discharge roller.

FIG. 9 is a structural view showing the structure of pressing the paper P against the discharge-driving roller 44*a*. Further, FIG. 9 is a little different in the position of the pressing roller 81 with respect to the virtual surface S from FIG. 5 in order to easily illustrate the effects of the embodiment. As shown in FIG. 9, the pressing roller 81 presses the paper P against the discharge-driving roller 44*a*, at the downstream from (above) the discharge-driving roller 44*a*. The paper P is curved by the pressing force and a reaction force to flattening the curve is generated. Meanwhile, the guide roller 43 comes in contact with the paper P, upstream from (under) the discharge-driving roller 44*a*. The opposite side of the paper P is likely to be raised on the discharge-driving roller 44*a* upward to the discharge-driven roller 44*b* by the reacting force due to the pressing force of the pressing roller 81, but the guide roller 43 presses down the paper. Accordingly, the guide roller 43 relatively presses the paper P against the discharge-driving roller 44*a*. As described above, the pressing rollers 81 and the guide roller 43 cooperate with each other to press the paper up and down (upstream and downstream).

As a result, the paper P is strongly pressed to the discharge-driving roller 44*a* by the reaction force (stiffness) for flattening. That is, the force pressing the paper P against the discharge-driving roller 44*a* is generated by three-point bending.

According to the configuration described above, it is possible to completely feed the lower end of the paper P to the holding surface 61 from the vicinity of the discharge roller 44, by using the pressing rollers 81. Meanwhile, since the paper pressing mechanism 47 has the structure that allows the paper P to be fed out in a protruding state, it is possible to hold the paper P to overlap each other without making the paper pressing mechanism 47 a movable type, such that it is possible to provide the recording apparatus 1 having a simple configuration without complicated control. In particular, the longitudinal disposition, like the recording apparatus 1, is preferable to reduce the disposition area by reducing the Y-axial length as much as possible.

Although it is necessary to incline the virtual surface S in the feeding-out direction of the paper P by the discharge roller 44 such that the paper P is stably facing the paper cassette 5 in order to reduce the Y-axial length as much as possible, it is preferable to make the virtual surface S as parallel as possible with the Z-axial direction. However, as the virtual surface S comes closer in the Z-axial direction when the disposition area of the recording apparatus 1 is reduced, it is difficult to feed the lower end of the paper P and the lower end of the paper P is easily stopped at the discharge roller 44. This is because when the virtual surface S comes closer in the Z-axial direction, that is, the paper P is substantially vertically fed out, the nip point of the discharge roller 44 significantly lowers from the top of the discharge-driving roller 44*a*, such that the discharge-driving roller 44*a* slides (due to insufficient friction) on the lower end of the paper P offset from the nip point, and accordingly, the paper P fails to pass the top of the discharge-driving roller 44*a* and stops at the position. Therefore, according to the invention, it is possible to reliably implement a simple configuration for feeding the paper P to the holding surface 61.

Further, since the discharge-driving roller 44*a* assists feeding of the lower end of the paper P in rotation contact with the lower end of the paper P right after being fed out, it is possible to more reliably feed the paper P to the holding surface 61.

Further, as the paper P is pressed against the discharge-driving roller 44*a* by the pressing roller 81 disposed above (downstream) the discharger roller 44, the friction force between the paper P and the discharge-driving roller 44*a* is increased, such that it is possible to improve the transport force of the discharge-driving roller 44*a* by suppressing slip. Since the transport force of the discharge-driving roller 44*a* is not increased directly by the discharge-driven roller 44*b*, it is possible to achieve transport force for stably feeding out the paper P, with the pinching force of the discharge-driving roller 44*a* and the discharge-driven roller 44*b* maintained.

Further, since the guide roller 43 is disposed at the side of the discharge-driving roller 44*b*, under (upstream) the discharge roller 44 and presses both upper and lower sides (upstream and downstream sides) in cooperation with the pressing roller 81, it is possible to further improve the transport force of the discharge-driving roller 44*a*.

Further, since the paper P is kept pressed against the discharge-driving roller 44*a* by the pressing roller 81, the lower end of the paper P that is fed out is feed to the holding surface 61 from the vicinity of the discharge roller 44. That is, the lower end of the paper P is not stopped around the discharge roller 44, such that it is possible to prevent jam.

Further, since the member (pressing roller 81) that presses the paper P is implemented by a freely rotatable roller in the paper pressing mechanism 47, it is possible to reduce frictional resistance against feeding of the paper pressing mechanism 47. Therefore, it is possible to stably feed out the paper P to overlap the previous paper P.

Further, as the pressing roller 81 is implemented by a star wheel, the contact area to the paper P can be decreased, such that it is possible to reduce the frictional resistance against the feeding-out while suppressing ink from sticking on the pressing roller 81.

Further, as the pressing rollers 81 are disposed in a pair at the left and right sides, it is possible to press the paper P at two positions in the width direction, such that it is possible to press the paper P throughout the width region. Therefore, it is possible to more reliably feed the lower end of the paper P to the holding surface 61.

Further, as the support 62*a* and the paper inlet 62*b* are disposed in the discharged-paper holding unit 52, it is possible to appropriately hold the paper P at the holding position by the support portion 62*a* and smoothly guide the lower end of the paper P to the holding position by using the paper inlet 62*b*. Further, it is possible to effectively prevent contact between the held paper P and the discharge roller 44.

Further, as the discharged-paper holding unit 52 is formed on the outer surface of the cassette body 51, it is possible to separate the discharged-paper holding unit 52 as an integral unit with the cassette body 51, such that it is possible to easily separate the discharged-paper holding unit 52 even if paper P with small dimensions (postcard) is held.

Further, in the embodiment, although the member (pressing roller 81) that presses the paper P is implemented by a freely rotatably roller, the member is not limited thereto as long as the member can press the paper P against the holding surface 61 while allowing the discharge roller 44 to feed out the paper. For example, the member may be a cylindrical fixing member, a semi-cylindrical fixing member, and triangle pole-shaped fixing member having the holding surface 61 as the front. That is, it may be considered to use a fixing member with an inclined surface making the holding surface 61 inclining upward with respect to the virtual surface S or a curved surface as a contact surface.

Further, although two pressing rollers 81 are disposed in parallel in the width direction (the direction perpendicular to the feeding-out direction) of the paper P in the embodiment, one pressing roller 81 may be disposed or three or more pressing rollers may be disposed in parallel in the width direction.

Further in the embodiment, each of the pressing rollers 81 may be directly biased or rotatably biased in the protrusion direction to each of the roller frames 82.

The entire disclosure of Japanese Patent Application No. 2011-26867, filed Feb. 10, 2011 and the entire disclosure of Japanese Patent Application No. 2011-26868, filed Feb. 10, 2011 are expressly incorporated by reference herein.

What is claimed is:

1. A recording apparatus comprising:

an image recording unit that records an image on a recording medium;

a medium discharge unit that includes a nip roller composed of a driving roller and a driven roller and feeds out a recorded recording medium upward;

a holding unit that holds the recorded recording medium fed out from the medium discharge unit in a standing position; and a medium pressing unit that protrudes to the holding unit with respect to a virtual surface in the feeding-out direction of the recording medium by the nip roller of the medium discharge unit, opposite to the holding unit, and presses the recorded recording medium fed out from the medium discharge unit to the holding unit, a medium cassette that accommodates a non-recorded recording medium in a standing posture, and is detachable and attachable to a body case of the recording apparatus, wherein the holding unit is formed on the outer surface of the medium cassette.

2. The recording apparatus according to claim 1, wherein the driving roller of the nip roller of the medium discharge unit is disposed at the holding unit.

3. The recording apparatus according to claim 2, wherein the lower end portion of the recorded recording medium fed out from the medium discharge unit is moved to the holding unit by the driving roller.

4. The recording apparatus according to claim 3, wherein the holding unit has an inclined portion that guides the lower end portion of the recording medium, which is moved to the holding unit by the driving roller, downward at an angle.

5. The recording apparatus according to claim 4, wherein the holding unit has a support portion that continues into the inclined surface and supports the recording medium from the lower portion.

6. The recording apparatus according to claim 1, wherein the medium pressing unit includes a freely rotatable roller that rotates in contact with the recording medium.

7. The recording apparatus according to claim 1, wherein a plurality of the medium pressing units are disposed in the direction perpendicular to the feeding-out direction.

8. The recording apparatus according to claim 1, further comprising:

a guide roller that is disposed upstream from the medium discharge unit and comes in contact with the surface opposite to the surface of the holding unit of the recording medium, wherein the guide roller protrudes with respect to the virtual surface and presses the recording medium against the holding unit.

* * * * *